US007001878B2

(12) United States Patent
De Buzzaccarini et al.

(10) Patent No.: US 7,001,878 B2
(45) Date of Patent: Feb. 21, 2006

(54) LIQUID UNIT DOSE DETERGENT COMPOSITION

(75) Inventors: Francesco De Buzzaccarini, Breendonk (BE); Lorenzo Matteo Pierre Gualco, Brussels (BE)

(73) Assignee: The Procter & Gamble Company, Cincinnati, OH (US)

( * ) Notice: Subject to any disclaimer, the term of this patent is extended or adjusted under 35 U.S.C. 154(b) by 11 days.

(21) Appl. No.: 10/946,978

(22) Filed: Sep. 22, 2004

(65) Prior Publication Data

US 2005/0065053 A1 Mar. 24, 2005

(30) Foreign Application Priority Data

Sep. 22, 2003 (EP) ..... 03077991

(51) Int. Cl.
*C11D 17/00* (2006.01)

(52) U.S. Cl. ..... 510/295; 510/296; 510/297; 510/426; 510/439; 510/481; 510/491

(58) Field of Classification Search ..... 510/295, 510/296, 426, 297, 389, 481, 491, 439
See application file for complete search history.

(56) References Cited

U.S. PATENT DOCUMENTS 3,953,351 A * 4/1976 Keller ..... 510/338
6,479,448 B1 * 11/2002 Cropper et al. ..... 510/296

FOREIGN PATENT DOCUMENTS

WO WO 02/057401 * 7/2002

* cited by examiner

*Primary Examiner*—Necholus Ogden
(74) *Attorney, Agent, or Firm*—Armina E. Matthews; Kim W. Zerby; Steven W. Miller

(57) ABSTRACT

The present invention relates to a liquid unit dose comprising a water-soluble packet and a liquid encased within the packet, the liquid being a detergent composition comprising:

from 5% to 80% by weight of surfactant;

from 1% to 15% by weight of non-aqueous solvent;

less than 10% by weight of water;

wherein the liquid detergent composition comprises fatty acid and further comprises fatty acid soap, wherein the molar ratio of fatty acid to fatty acid soap is from 5:1 to 1:5, and wherein the total level of fatty acid (neutralized and unneutralized) is from 20% to 50% by weight of the liquid composition.

9 Claims, No Drawings

LIQUID UNIT DOSE DETERGENT COMPOSITION

The present invention relates to liquid unit dose comprising a water-soluble packet and a liquid composition encased within the packet wherein the liquid composition comprises neutralized fatty acid soap and free fatty acid.

U.S. Pat. No. 3,953,351, issued on Apr. 27$^{th}$ 1976, discloses a detergent composition comprising from 5% to 80% nonionic surfactant, 20% to 95% fatty acid and from 0% to 20% water; the fatty acid being partly neutralized to produce a soluble soap. The detergent composition has a pH in the range of 4 to 8.

WO02/057401, published on 25$^{th}$ Jul. 2002, discloses somewhat similar detergent compositions and suggests that the compositions are suitable for use in water-soluble containers. However the detergent compositions disclosed in this application comprise less than 20% fatty acid.

However it remains a problem associated with non-aqueous, or low water, detergent compositions that high amounts of non-aqueous solvents are needed in order to maintain a single-phase, homogeneous, pourable liquid, and such high amounts of non-aqueous solvents are expensive. In particular while fatty acids provide significant benefits for cleaning, it is difficult to incorporate high levels of fatty acids in single-phase, low water, liquid unit dose compositions because of their limited solubility.

Hence it is an objective of the present invention to provide a liquid unit dose comprising a water-soluble packet and a liquid encased within the packet, wherein the liquid comprises from 1% to 15% by weight of non-aqueous solvent and less than 10% by weight of water.

SUMMARY OF THE INVENTION

In order to address the invention problem set out above the present invention provides a liquid unit dose comprising a water-soluble packet and a liquid encased within the packet, the liquid being a detergent composition comprising:

from 5% to 80% by weight of surfactant;

from 1% to 15% by weight of non-aqueous solvent;

less than 10% by weight of water;

and wherein the liquid detergent composition comprises fatty acid and further comprises fatty acid soap, wherein the molar ratio of fatty acid to fatty acid soap is from 5:1 to 1:5, and wherein the total level of fatty acid (neutralized and unneutralised) is from 20% to 50% by weight of the liquid composition.

Preferably the pH of the composition, when diluted to a 1% solution in distilled water, is less than pH 7.5.

DETAILED DESCRIPTION OF THE INVENTION

The term "liquid detergent composition" is used herein to mean single-phase, homogeneous solutions.

The technical problem addressed is solved by under-neutralising the liquid detergent composition so that the composition comprises a combination of unneutralised fatty acid and neutralised fatty acid soap. The molar ratio of fatty acid to soap is from 5:1 to 1:5, preferably from 1:1 to 1:5.

The liquid composition may contain active ingredients suitable for various applications; domestic and consumer products, e.g. laundry cleaning and treatment, dish and hard surface cleaning, shampoo, bath additives. Particularly preferred liquids are suitable for use as liquid detergents in the cleaning of clothes, dishes, and other household surfaces.

The liquid composition preferably has a density of 0.8 kg/l to 1.3 kg/l, preferably about 1.0 to 1.1 kg/l. The liquid composition can made by any method and can have any viscosity, typically depending on its ingredients. The viscosity may be controlled, if desired, by using various viscosity modifiers such as hydrogenated castor oil and/or solvents. Hydrogenated castor oil is commercially available as Thixcin®. Suitable solvents are described in more detail below.

The liquid compositions of the present invention are concentrated and contain relatively low levels of water. The liquid compositions comprise less than 10% by weight water, and preferably less than 5% by weight water.

The liquid of the present invention preferably has a pH of less than 7.5, when measured by dissolving the liquid composition to a level of 1% in an aqueous medium.

Preferred ingredients of the liquid composition

The preferred amounts of ingredients described herein are % by weight of the composition herein as a whole.

The liquid detergent composition comprises from 5% to 80%, and preferably from 10% to 50%, by weight of surfactant. Preferred surfactants are anionic surfactants and nonionic surfactants, although cationic, amphoteric and zwitterionic surfactants may also be used. The liquid detergent composition further comprises from 20% to 50%, and preferably from 22% to 40%, by weight of fatty acid. Preferred fatty acids are $C_{12}$ to $C_{18}$, saturated or unsaturated, fatty acid, preferably selected from the group consisting of rapeseed, coconut, palm, palm kernel, tallow fatty acid, or mixtures thereof. Rapeseed fatty acid is particularly preferred. Other optional water-soluble builders such as phosphate, or water-insoluble builders such as zeolite may also be used. Other optional and preferred components are chelating agents such as carboxylates and phosphonates, enzymes and/or bleaching agents, such as a preformed peroxyacid.

Highly preferred are also perfume, brightener, buffering agents (to maintain the pH in the desired range), fabric softening agents, including clays and silicones benefit agents, suds suppressors.

In hard-surface cleaning compositions and dish wash compositions, it is preferred that at least a water-soluble builder is present, such as a phosphate, and preferably also perfume, enzymes, and/or bleach.

In fabric enhancing compositions, preferably at least a perfume and a fabric benefit agent are present for example a cationic softening agent, clay softening agent, anti-wrinkling agent, and/or fabric substantive dye.

Highly preferred in all above compositions are also non-aqueous solvents, such as alcohols, diols, glycerol, glycols, polyalkylane glycols, such as polyethylene glycol, propane diol. Highly preferred are mixtures of solvents, such as mixtures of alcohols, mixtures of diols and alcohols, mixtures. Highly preferred may be that (at least) an alcohol, diol, and preferably even glycerol are present. For the purposes of the present invention ethanolamines which act as counterions in various salts are not considered as solvents. The compositions of the invention are preferably concentrated liquids comprising from 1% to 15% by weight of non-aqueous solvent. Preferably the solvent is present at a level of at least 5% or even at least 10% by weight of the composition.

One of the main purposes of the non-aqueous solvent is to regulate the viscosity of the composition. Preferred compositions have a viscosity of from 100 to 1000 centipoise when measured at 21° C. and at a shear rate of 20 $s^{-1}$. Most preferably the viscosity is from 300 to 600 centipoise when measured at 21° C. and at a shear rate of 20 $s^{-1}$.

Highly preferred is that the composition comprises a plasticiser for the water-soluble pouch material, for example one of the plasticisers described above, for example glycerol. Such plasticisers can have the dual purpose of being a solvent for the other ingredients of the composition and a plasticiser for the pouch material.

Preferred processes for forming the liquid-filled pouch include vertical-form-fill-sealing, often referred to as VFFS, and thermo-forming or vacuum-forming processes. The latter two processes are often combined as a vacuum-thermo-forming process, such processes being exemplified in U.S. Pat. No. 3,218,776, issued on 23rd Nov. 1965, and assigned to Cloud Machine Corporation; and in WO02/60758, published on 8th Aug. 2002, and assigned to The Procter & Gamble Company, both incorporated herein by reference. The general state of the art of forming pouches is described in "Packaging of Pesticides and potentially Hazardous Chemicals for Consumer Use", Edwards, David B., 1995, published by PIRA (ISBN 1 85802 102 2), page 14 et seq., incorporated herein by reference.

Laundry detergent compositions, including those of the present invention, almost invariably comprise perfume. Conventionally the perfume may be considered as providing two different but complimentary benefits: firstly to provide a pleasing fragrance to the consumer when the laundry detergent package is opened, and/or the laundry detergent composition is poured into a dispenser, a container or a washing machine; and secondly to provide fragrant molecules which may be substantively attached to fabrics in the wash process and therefore provide a pleasing fragrance to those fabrics after the wash process, e.g. when they are ironed or worn.

In the context of the present invention it is preferred that perfumes are formulated principally with the second of these two benefits in mind. This is because the laundry detergent composition of the present invention is encapsulated within a water-soluble packet which acts as a barrier to perfume. Thus even the more volatile fragrance molecules which are traditionally used in order to give a pleasing fragrance to the consumer when the laundry detergent package is opened, are effectively trapped within the packet. Consequently it is preferred that the perfume formulator will omit such relatively volatile components from the perfume formulation. This can result in either a less costly perfume, or the cost savings may be reinvested in relatively substantive fragrance molecules which provide a still more pleasing fragrance to those fabrics after the wash process, at the same perfume cost as traditional perfumes.

EXAMPLES

In tables 1 and 2, examples 1, 2 and 3 are representative of the invention and contain partially neutralized fatty acids. Composition A is a reference composition having fully neutralized fatty acids. Table 1 reports the % by weight of the components. Table 2 reports the molar amount of the acids and bases and a calculation of the % neutralization of the fatty acids (it is assumed that the alkylbenezene sulfonic acid is always fully neutralized).

TABLE 1

| | | Ex. 1 % by weight | Ex. 2 % by weight | Ex. 3 % by weight | A % by weight |
|---|---|---|---|---|---|
| 1 | Alkylbenzene sulfonic acid | 22.8 | 22.5 | 22.5 | 22.8 |
| 2 | C12–18' alkyl fatty acid (DTPKA) | 17.3 | 30 | 17 | 17.3 |
| 3 | C18'–18" alkyl fatty acid (Rapeseed) | — | — | 10 | — |
| 4 | C13–15 alcohol 7-ethoxylate | 19 | 19 | 20 | 19 |
| 5 | Monoethanolamine | 4.4 | 4.5 | 9.2 | 8.3 |

TABLE 1-continued

| | | Ex. 1 % by weight | Ex. 2 % by weight | Ex. 3 % by weight | A % by weight |
|---|---|---|---|---|---|
| 6 | C8–10 alkyl amidopropyldimethyl amine | 1.8 | 1.8 | 1.8 | 1.8 |
| 7 | Ethoxylated polyethyleneimine | 3.2 | 3.2 | 3.2 | 3.2 |
| 8 | Sodium hydroxide | 0.9 | — | — | — |
| 9 | Potassium hydroxide | — | 2.0 | — | — |
| 10 | Propandiol | 22 | 10 | 11 | 22 |
| 11 | Protease/amylase enzymes | 1.3 | 1.3 | 1.3 | 1.3 |
| 12 | Water | 4.5 | 5.0 | 5.0 | 4.5 |
| 13 | Perfume, dyes, minors | To 100 | To 100 | To 100 | To 100 |

TABLE 2

| | | Ex. 1 | Ex. 2 | Ex. 3 | A |
|---|---|---|---|---|---|
| 14 | Moles Alkylbenzene sulfonic acid (1)* | 0.0698 | 0.0689 | 0.0698 | 0.0698 |
| 15 | Total moles of bases (from rows 5 to 9)* | 0.1053 | 0.1201 | 0.151 | 0.145 |
| 16 | Moles of bases available to neutralize the fatty acids (rows 15–14)* | 0.0355 | 0.0512 | 0.081 | 0.0752 |
| 17 | Moles of fatty acids (from rows 2 and 3)* | 0.0759 | 0.1315 | 0.110 | 0.0759 |
| 18 | % Neutralization of the fatty acids (rows 16/17) | 47% | 39% | 74% | 99% |
| | pH (in 1% distilled water) | 7.2 | 7.2 | n.a. | 8.2 |

*moles/100 grams of composition

Because of the lower level of monoethanolamine, examples 1, 2 and 3 are cheaper than composition A and have a better color stability on storage. All three compositions have good product characteristics and good wash performance.

TABLE 3

| | | Ex. 4 | Comparative example B |
|---|---|---|---|
| 1 | Alkylbenzene sulfonic acid (MEA salt) | 27.3 | 20.0 |
| 2 | C13–15 alcohol 7-ethoxylate | 20.0 | 20.0 |
| 3 | C8–10 alkyl amidopropyl-dimethyl amine | 1.8 | — |
| 4 | C12–18' alkyl fatty acid (DTPKA), MEA salt | — | 35.0 |
| 5 | C12–18' alkyl fatty acid (DTPKA), acid | 18.0 | — |
| 6 | C18'–18" alkyl fatty acid (Rapeseed), acid | 10.0 | — |
| 7 | Propandiol | 10.0 | 11.0 |
| 8 | Ethanol | — | 4.3 |
| 9 | Monoethanolamine (free) | — | 0.36 |
| 10 | Sodium hydroxide | 1.0 | — |
| 11 | Phosphonate | 0.2 | 6.0 |
| 12 | Ethoxylated tetra ethylene pentamine | 1.6 | — |
| 13 | Polyethyleneimine ethoxylate | 1.6 | — |
| 14 | Enzyme, minors, | Balance to 100 | Balance to 100 |
| | Total Monoethanolamine (calculated) | 7.8 | 10.9 |
| | Non-aqueous solvent | 10.0 | 15.3 |
| | pH (in 1% distilled water) | 7.9 | 8.7 |
| | Viscosity* at 21° C. | 580 | 3630 |
| | at 10° C. | 1280 | Solid - non measurable |

*Viscosity measured using a Carrimed CSL 2 100, at a shear rate of 20 $s^{-1}$, and reported in centiPoise.

TABLE 4 calculation of % neutralization

| | | Ex. 4 | Example B |
|---|---|---|---|
| 15 | Moles Alkylbenzene sulfonic acid (1)* | 0.0706 | 0.0517 |
| 16 | Total moles of bases (from rows 3, 9, 10, 12, 13)* | 0.1635 | 0.179 |
| 17 | Moles of bases available to neutralize the fatty acids (rows 16–15)* | 0.093 | 0.127 |
| 18 | Moles of fatty acids (from rows 4, 5, 6)* | 0.114 | 0.122 |
| 19 | % Neutralization of the fatty acids (rows 18/17) | 81% | 104% |
| | pH in 1% distilled water | 7.9 | 8.7 |

*moles/100 grams of composition

All documents cited in the Detailed Description of the Invention are, in relevant part, incorporated herein by reference; the citation of any document is not to be construed as an admission that it is prior art with respect to the present invention.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A liquid unit dose comprising a water-soluble packet and a liquid detergent composition encased within the packet, wherein the liquid detergent composition comprises:

a) from about 5% to about 80% by weight of surfactant;

b) from about 1% to about 15% by weight of non-aqueous solvent;

c) less than about 10% by weight of water;

d) an unneutralized fatty acid; and e) a fatty acid soap;

wherein the molar ratio of the unneutralized fatty acid to the fatty acid soap is from about 5:1 to about 1:5, and wherein the total amount of unneutralized fatty acid and fatty acid soap is from about 20% to about 50% by weight of the liquid detergent composition.

2. The liquid unit dose according to claim 1, wherein the molar ratio of the unneutralized fatty acid to the fatty acid soap is from about 1:1 to about 1:5.

3. The liquid unit dose according to claim 1, wherein the pH of the composition, when diluted to a 1% solution in distilled water, is less than about 7.5.

4. The liquid unit dose according to claim 1 wherein the fatty acid soap is a salt neutralized with a neutralizing agent selected from the group consisting of alkali metal hydroxide, alkaline earth metal hydroxide, monoethanolamine, triethanolamine or mixtures thereof.

5. The liquid unit dose according to claim 4 wherein the soap is neutralized with monoethanolamine.

6. The liquid unit dose according to claim 1 wherein the liquid detergent composition comprises fatty acid which is a C12 to C18 fatty acid.

7. The liquid unit dose according to claim 6 wherein the fatty acid is selected from the group consisting of rapeseed, coconut, palm, palm kernel, tallow fatty acid, or mixtures thereof.

8. The liquid unit dose according to claim 7 wherein the fatty acid comprises rapeseed fatty acid.

9. The liquid unit dose according to claim 1 wherein the water-soluble packet comprises a water-soluble film, and wherein the water-soluble film comprises polyvinyl alcohol.

* * * * *